US009332615B1

(12) United States Patent
Peng

(10) Patent No.: US 9,332,615 B1
(45) Date of Patent: May 3, 2016

(54) CORD DIMMER SWITCH

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Dongguan (CN)

( * ) Notice: Subject to any disclaimer, the term of this patent is extended or adjusted under 35 U.S.C. 154(b) by 0 days.

(21) Appl. No.: 14/589,008

(22) Filed: Jan. 5, 2015

(51) Int. Cl.
*H05B 37/02* (2006.01)

(52) U.S. Cl.
CPC ..... *H05B 37/0209* (2013.01)

(58) Field of Classification Search
CPC ..... H05B 37/0209
USPC ..... 315/291
See application file for complete search history.

(56) References Cited

U.S. PATENT DOCUMENTS

| | | | | |
|---|---|---|---|---|
| 5,499,930 | A * | 3/1996 | Cieri | H01R 12/67 439/374 |
| 2007/0216318 | A1* | 9/2007 | Altonen | G02B 6/0001 315/209 R |
| 2010/0052577 | A1* | 3/2010 | Brownlee | H02G 3/00 315/362 |
| 2015/0109721 | A1* | 4/2015 | Willcocks | H05B 37/0272 361/679.01 |

* cited by examiner

*Primary Examiner* — Don Le
(74) *Attorney, Agent, or Firm* — Alan D. Kamrath; Kamrath IP Lawfirm, P.A.

(57) ABSTRACT

A cord dimmer switch includes a main body, a power cord and a rotating part. The main body includes a circuit device installed in the main body, a through hole formed at the top of the main body, and a rectangular notch formed on a corresponsive adjacent side of the main body. The power cord is connected to both ends of the main body for supplying power to the circuit device and a lamp, and the circuit device has a dimming column. The rotating part is connected to the dimming column to drive the dimming column to rotate synchronously. The rotating part includes a turntable corresponsive to the rectangular notch and a knob corresponsive to the through hole, a part of the periphery of the turntable is protruded out from the rectangular notch, and the top edge of the knob is protruded out from the through hole.

2 Claims, 5 Drawing Sheets

CORD DIMMER SWITCH

BACKGROUND OF THE INVENTION

1. Field of the Invention

The present invention relates to a cord dimmer switch, and more particularly to the cord dimmer switch having a double rotary dimming structure provided for users to choose and use, so as to make the operation of adjusting the light intensity of a lamp more convenient.

2. Description of the Related Art

Lamp is a necessary electric appliance for providing light in our daily life, and the common lamps include table lamps, night lights, fluorescent lamps, atmosphere lamps, etc. A conventional lamp generally comprises a lamp body and a cord switch connected to the lamp body and operated by turning a knob or pressing or pushing a button in order to turn on or off the lamp body and the light of the lamp. Another conventional lamp comprises a lamp body and a cord dimmer switch connected to the lamp body, and the cord dimmer switch is operated by turning a knob to adjust and change the property (such as resistance) of a passing current, so as to adjust the light intensity of the lamp.

In general, there are two types of conventional cord dimmer switches as described below. With reference to FIG. 1 for a conventional cord dimmer switch of the first type, the cord dimmer switch 1 comprises a main body 10, a power cord 11 connected to the main body 10, and a knob 12 installed at the top of the main body 10. When it is necessary to adjust the light intensity of a lamp, a user presses and turns the knob 12 by a finger (such as the index finger near the knob 12), so as to change the property of the passing current. Since the knob 12 is situated at the top of the main body 10, the user just can use the index finger to apply a force to press and turn the knob 12 conveniently and ergonomically. If the user uses any other finger for the operation, the operation will be unsmooth. With reference to FIG. 2 for a cord dimmer switch 2 of the second type, the cord dimmer switch 2 also comprises a main body 20, a power cord 21 and a knob 22, and the difference between this cord dimmer switch 2 and the aforementioned cord dimmer switch 1 resides on that the knob 22 is installed on a side of the main body 20, so that when it is necessary to adjust the light intensity of a lamp, the user needs to press and turn the knob 22 by a finger (such as the thumb near the knob 22), so as to change the property of the passing current. Since the knob 22 is situated on a side of the main body 20, the user just can use the thumb to apply a force to press and turn the knob 12 conveniently and ergonomically. If the user uses any other finger for the operation, the operation will be unsmooth.

The structure of human body is very mysterious, but also very fragile, and an operation of any object must have its necessity and restriction, and thus when we operate and turn the conventional cord dimmer switch 1 of the first type, the operation will be unsmooth or our finger may feel uncomfortable or even be hurt if we use any finger other than the index finger for the operation. Similarly, when we operate and turn the conventional cord dimmer switch 2 of the second type, our finger may feel uncomfortable or even be hurt if we use any finger other than the thumb for the operation. Obviously, the conventional cord dimmer switches 1, 2 are just dimming structures only, but their operation and use are inconvenient, and thus require further improvements.

SUMMARY OF THE INVENTION

In view of the foregoing problem of the prior art, the inventor or the present invention designed and developed a cord dimmer switch in accordance with the present invention to overcome the problem of the prior art.

Therefore, it is a primary objective of the present invention to provide a cord dimmer switch capable of adjusting the light intensity of a lamp conveniently.

Another objective of the present invention is to provide a cord dimmer switch with a double rotary dimming structure for the choice of users.

To achieve the aforementioned objectives, the present invention provides a cord dimmer switch comprising a main body, a power cord and a rotating part, wherein the main body is formed by an upper casing and a lower casing engaged with each other, and an accommodating space is defined between opposite sides of the upper and lower casings and provided for installing a circuit device therein, and a through hole is formed at the top of the upper casing, and a rectangular notch is formed on a corresponding adjacent side of the upper casing, and a rectangular plate is formed on a corresponding side of the lower casing and configured to be corresponsive to the rectangular notch and the rectangular plate can be into a gap in the rectangular notch; the power cord is coupled to both ends of the main body and provided for supplying electric power to the circuit device and a lamp, and the circuit device includes a dimming column installed thereon and provided for rotating and controlling the lamp to turn on or off the lamp and adjust the brightness of the lamp to different levels; and the rotating part is sheathed and combined with the dimming column and rotated to drive the dimming column to rotate synchronously, characterized in that the rotating part includes a turntable configured to be corresponsive to the rectangular notch and a knob configured to be corresponsive to the through hole, and the rotating part is sheathed and combined to the dimming column, and after the upper and lower casings are engaged with each other, the turntable will be disposed in a gap between the rectangular notch and the rectangular plate, and a part of the periphery of the turntable is protruded out from the rectangular notch, and the top edge of the knob is protruded out from the through hole.

In the cord dimmer switch, the turntable and the knob are integrally formed, and the outwardly extended periphery of the turntable has a serration, and the top of the knob has a plurality of concentric bumps.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
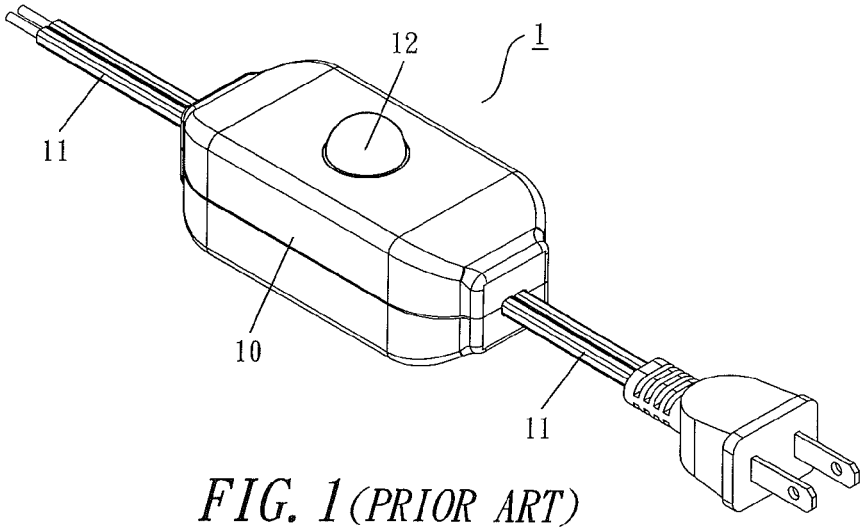
FIG. 1 (PRIOR ART)
FIG. 1 is a perspective view of a first type of a conventional cord dimmer switch.
Figure 2:
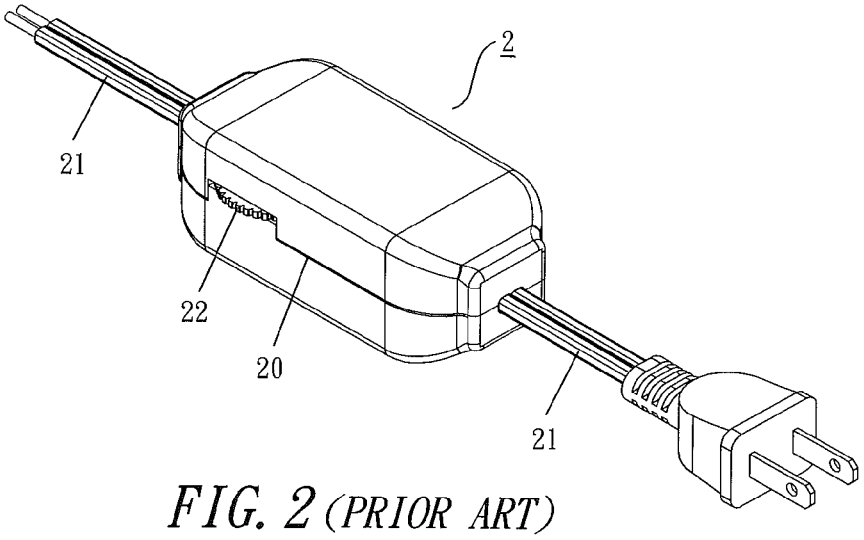
FIG. 2 (PRIOR ART)
FIG. 2 is a perspective view of a second type of a conventional cord dimmer switch.
Figure 3:
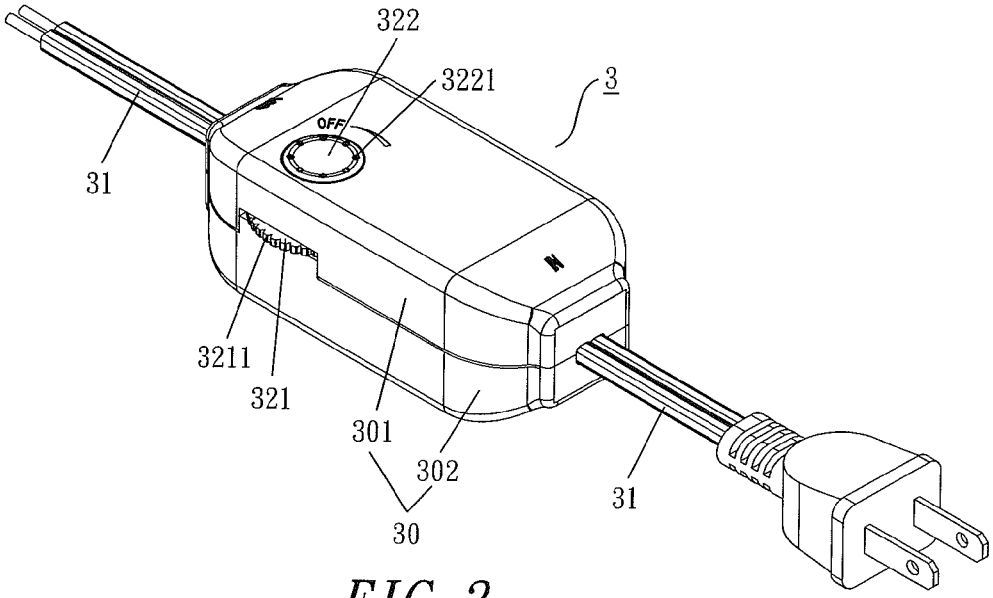
FIG. 3 is a perspective view of a cord dimmer switch in accordance with a preferred embodiment of the present invention.
Figure 4:
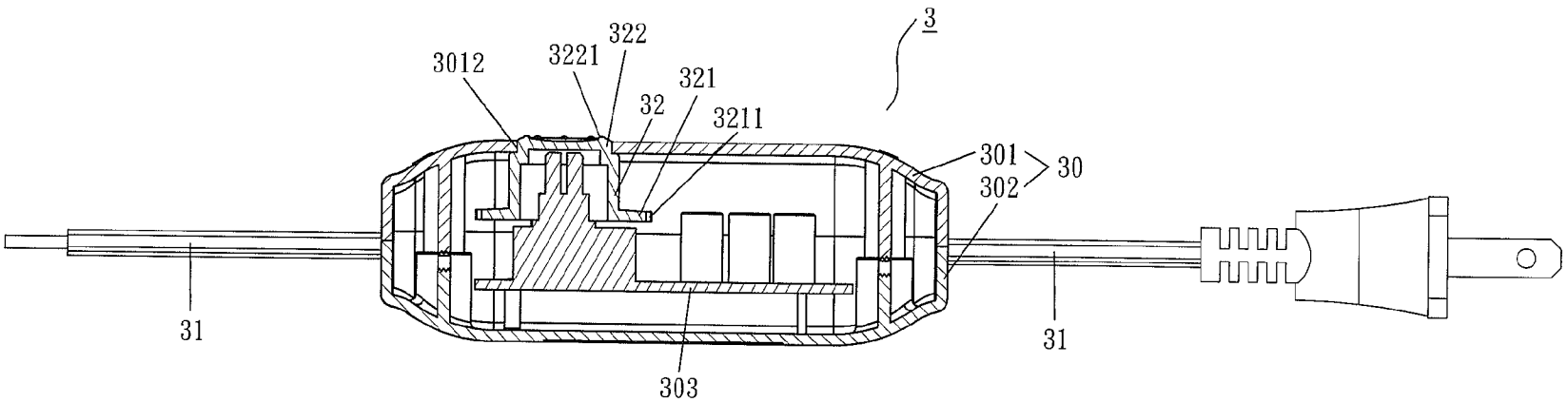
FIG. 4 is a cross-sectional view of a cord dimmer switch in accordance with a preferred embodiment of the present invention.
Figure 5:
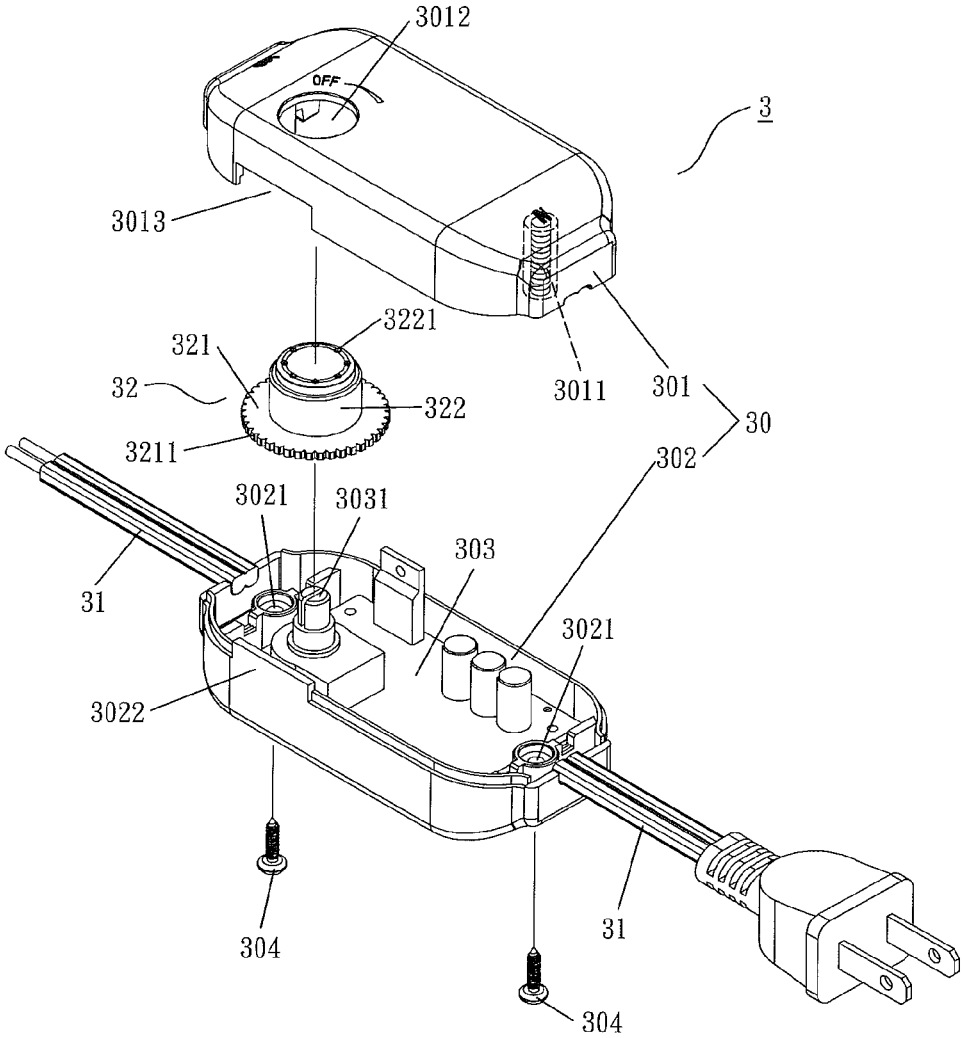
FIG. 5 is an exploded view of a cord dimmer switch in accordance with a preferred embodiment of the present invention.

With reference to FIGS. 3 to 5 for a cord dimmer switch in accordance with a preferred embodiment of the present invention, the cord dimmer switch 3 comprises a main body 30, a power cord 31 and a rotating part 32, wherein the main body 30 is formed by an upper casing 301 and a lower casing 302 engaged with each other, and an accommodating space is defined between opposite sides of the upper and lower casings 301, 302 and provided for installing a circuit device 303 therein, and a group of fasteners 304 (such as bolts) are passed from the bottom of the lower casing 302 into a column slot 3021 formed inside the lower casing 302 and secured with a group of internal threaded grooves 3011 inside the upper casing 301 respectively, and both ends of the upper and lower casings 301, 302 are connected to the power cord 31, and the power cord 31 is provided for supplying power to the circuit device 303 and a lamp (not shown in the figure); the upper casing 301 has a through hole 3012 formed at the top of the upper casing 301 and a rectangular notch 3013 formed on a corresponsive side of the upper casing 301, and the lower casing 302 has a rectangular plate 3022 formed on a side of the lower casing 302 and configured to be corresponsive to the rectangular slot 3013, such that when the upper and lower casings 301, 302 are engaged with each other, the rectangular plate 3022 will pressed into a gap between the rectangular plate 3022 and the rectangular notch 3013.

The circuit device 303 is coupled to an end of the power cord 31 to receive a mains power, and the other end of power cord 31 is coupled to a lamp (not shown in the figure). In addition to the circuit, the circuit device 303 further comprises a dimming column 3031, and the dimming column 3031 may be controlled to control the lamp and turn on or off the lamp, and adjust the lamp to different levels of brightness during the rotating process.

The rotating part 32 is connected to the dimming column 3031, and the rotating part 32 may be rotated to drive the dimming column 3031 to rotate synchronously. The rotating part 32 comprises a turntable 321 corresponsive to the rectangular notch 3013 and a knob 322 corresponsive to the through hole 3012, and the turntable 321 are the knob 322 are integrally formed with each other, and the turntable 321 has a serration 3211 formed on an externally expanded periphery of the turntable 321, and the knob 322 is relatively raised and has a plurality of concentric bumps 3221 formed on the top of the knob 322, and the rotating part 32 is connected to the dimming column 3031. After the upper and lower casings 301, 302 are engaged with each other, the turntable 321 will be disposed at a gap between the rectangular notch 3013 and the rectangular plate 3022; and a portion of the periphery of the turntable 321 is protruded out from the rectangular notch 3013, and the top edge of the knob 322 is protruded out from the through hole 3012 as shown in FIG. 3.

Figure 6:
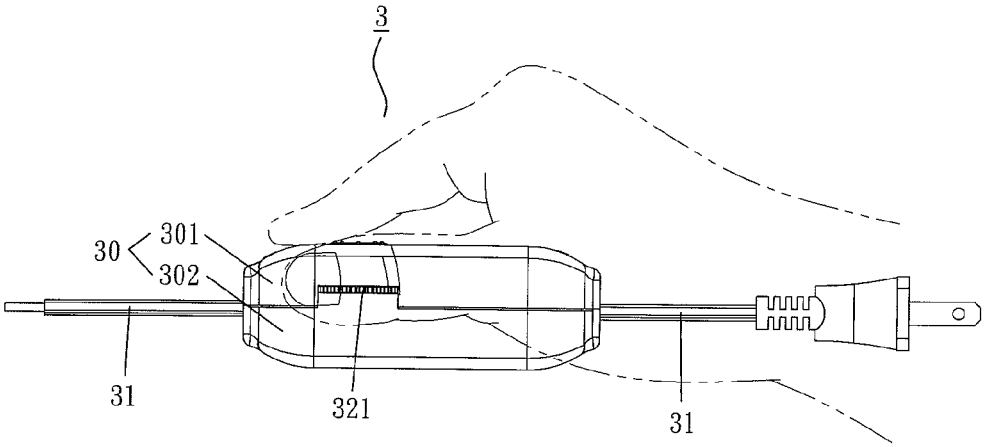
FIG. 6 is a schematic view of turning a turntable to dim a light in accordance with a preferred embodiment of the present invention.
Figure 7:
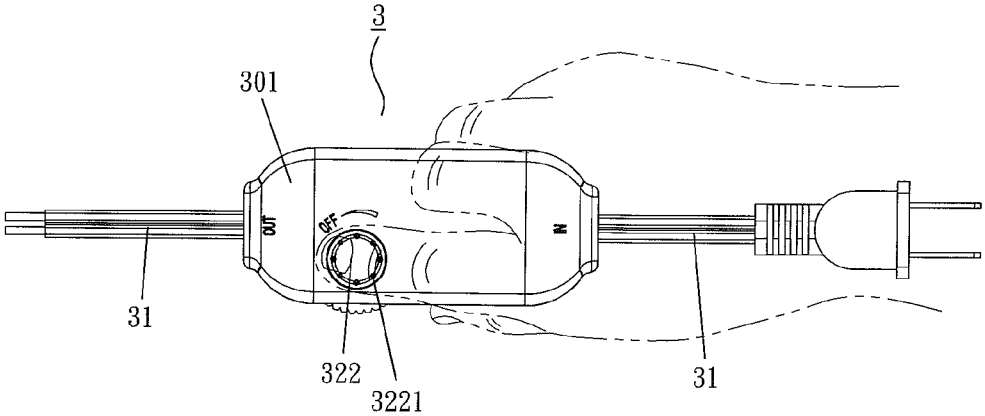
FIG. 7 is a schematic view of turning a knob to dim a light in accordance with a preferred embodiment of the present invention.

Since the cord dimmer switch 3 of the present invention has both turntable 321 and knob 322, therefore the turntable 321 may be used to adjust the brightness of the lamp or the knob 322 may be used to adjust the brightness of the lamp. In FIG. 6, when a user holds the cord dimmer switch 3 from top to bottom by the palm of the user's right hand, the user's right thumb is situated near the serration 3211 of the turntable 321, so that it is easy to turn the serration 3211 of the turntable 321 by the thumb in order to adjust the brightness of the lamp. In the process as shown in FIG. 7, the user' right index finger is situated near the bump 3221 of the knob 322. As a result, it is easy for the user to turn the bump 3221 of the turntable 321 by the right index finger in order to adjust the brightness of the lamp.

However, FIGS. 6 and 7 are provided for illustrating a preferred embodiment of the present invention only, but not intended for limiting the scope of the present invention, so that when the user selects other using modes to dim the lamp in accordance with the present invention, such modes are included in the scope of the present invention. For example, if the user grip the cord dimmer switch 3 from bottom to top instead of gripping the cord dimmer switch 3 from top to bottom by the right index finger, then the index finger will be placed next to the turntable 321 instead to achieve the effect of turning the serration 3211 of the turntable 321 by the index finger, so as to adjust the brightness of the lamp. In the meantime, the user's thumb is situated at the top of the cord dimmer switch 3 and next to the knob 322, so that the user may turn the bump 3221 of the turntable 321 to adjust the brightness of the lamp easily. All of the aforementioned modes are covered within the scope of the technical principle and structural characteristics of the present invention.

The cord dimmer switch 3 of the present invention includes the rotating part 32 with a double rotary dimming structure comprising both of the turntable 321 and the knob 322, so that the users may select and use the turntable 321 or the knob 322 to adjust the light intensity ergonomically, and the double rotary dimming structure is provided to improve the convenience of use.

In summation of the description above, the present invention complies with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. A cord dimmer switch, comprises a main body, a power cord and a rotating part, wherein the main body is formed by an upper casing and a lower casing engaged with each other, and an accommodating space is defined between opposite sides of the upper and lower casings and provided for installing a circuit device therein, and a through hole is formed at the top of the upper casing, and a rectangular notch is formed on a corresponding adjacent side of the upper casing, and a rectangular plate is formed on a corresponding side of the lower casing and configured to be corresponsive to the rectangular notch and the rectangular plate can be into a gap in the rectangular notch; the power cord is coupled to both ends of the main body and provided for supplying electric power to the circuit device and a lamp, and the circuit device includes a dimming column installed thereon and provided for rotating and controlling the lamp to turn on or off the lamp and adjust the brightness of the lamp to different levels; and the rotating part is sheathed and combined with the dimming column and rotated to drive the dimming column to rotate synchronously, characterized in that the rotating part includes a turntable configured to be corresponsive to the rectangular notch and a knob configured to be corresponsive to the through hole, and the rotating part is sheathed and combined to the dimming column, and after the upper and lower casings are engaged with each other, the turntable will be disposed in a gap between the rectangular notch and the rectangular plate, and a part of the periphery of the turntable is protruded out from the rectangular notch, and the top edge of the knob is protruded out from the through hole.

2. The cord dimmer switch of claim 1, wherein the turntable and the knob are integrally formed and the outwardly extended periphery of the turntable has a serration, and the top of the knob has a plurality of concentric bumps.

* * * * *